United States Patent [19]

McMichael

[11] Patent Number: 4,832,716

[45] Date of Patent: May 23, 1989

[54] AMBIENT FACIAL AIR CLEANER FOR CONTACT LENS INSERTION

[76] Inventor: Rose M. McMichael, 21 Carl Sandburg Dr., Trenton, N.J. 08690

[21] Appl. No.: 170,818

[22] Filed: Mar. 21, 1988

[51] Int. Cl.[4] ..... B01D 50/00

[52] U.S. Cl. ..... 55/467; 55/385.1; 55/471; 55/472; 55/DIG. 29; 55/DIG. 37; 98/36

[58] Field of Search ..... 55/385.1, 385.2, 385.7, 55/467, 471, 472, DIG. 29, DIG. 37, DIG. 42; 98/36, 115.1, 115.3

[56] References Cited

U.S. PATENT DOCUMENTS

| | | | |
|---|---|---|---|
| 2,754,746 | 7/1956 | O'Brien | 98/36 |
| 3,838,556 | 10/1974 | Finger | 55/385.1 |
| 3,998,142 | 12/1976 | Foreman et al. | 98/36 |
| 4,123,967 | 11/1978 | Shanis | 98/36 |
| 4,312,291 | 1/1982 | Knab | 55/472 X |
| 4,686,891 | 8/1987 | Pouchard | 98/36 |
| 4,737,173 | 4/1988 | Kudirka et al. | 55/471 X |

*Primary Examiner*—Charles Hart
*Attorney, Agent, or Firm*—William L. Muckelroy

[57] ABSTRACT

A facial air cleaner adapted to remove airborne particles in the vicinity of a person's face prior to insertion of contact lenses to eliminate the airborne particles from being deposited on the contact lenses during insertion. The cleaner is an enclosed unit which has an air inlet driven by an electric fan and conduit connected to the inlet adapted to provide a pattern of high and low velocity air flow through outlets arranged to surround the face and gently flood the hand holding the lens with cleaned air while a lens is being inserted.

4 Claims, 6 Drawing Sheets

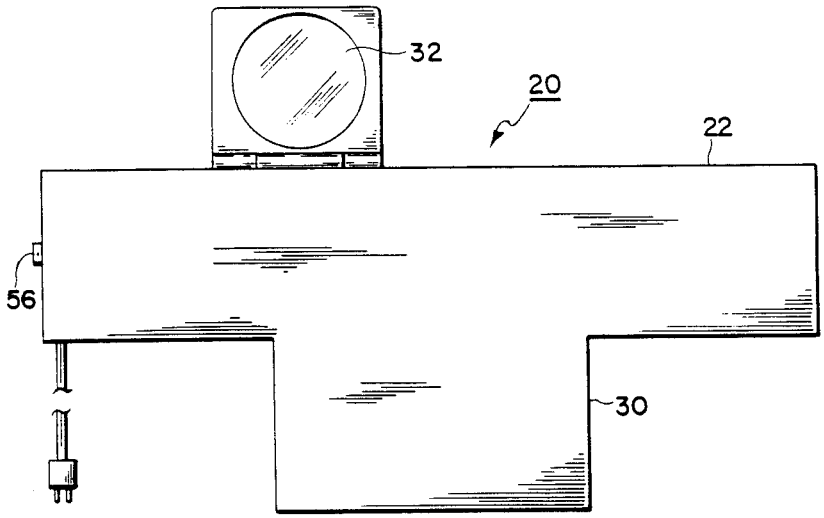
FIG. 3
FIG. 4
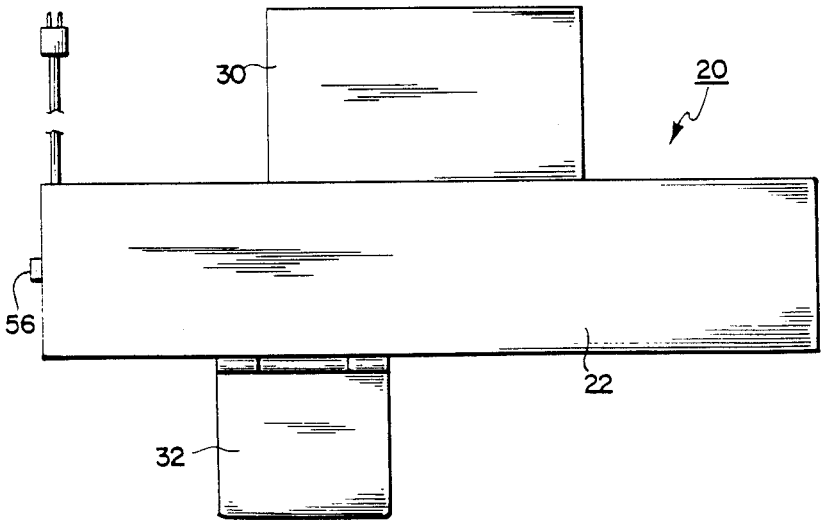

AMBIENT FACIAL AIR CLEANER FOR CONTACT LENS INSERTION

BACKGROUND OF THE INVENTION

1. Field of the Invention

This invention relates generally to air purifiers for use in the home or in the office for removing particulate contaminants from the atmosphere; and more particularly to a unit of this type specifically adapted to remove coarse airborne particles from the air surrounding the face during contact lens insertion and to prevent contamination of contact lens surfaces by airborne particulate matter during insertion.

2. Status of the Art

It is well known that modern homes and buildings are almost all virtually hermetically isolated from the exterior atmosphere and therefore undergo a gradual build-up of contaminants, such as lint, for example, which are internally generated. These contaminants have many sources, such as, for example, airborne fibers derived from rugs and other fabrics, hairs from pet animals and particulate matter thrown off by appliances such as air conditioners, furnaces, heaters and heat pumps, for example. As a consequence, although contact lenses are invariably inserted in a home or office environment, the interior, especially the air surrounding the face during insertion of these contact lenses, is not free of contaminants.

Various domestic filtration units are commercially available for home use. Thus the typical household air conditioner includes a fibrous or open-cell foam plastic filter to remove coarse particles from air passing through the conditioner. Some electric, gas and oil furnaces now on the market include a high voltage electro-static precipitator unit to purify the air passing therethrough.

One example of an air purifier unit indicative of the state of the art is the "Compact Air Purifier Unit" in U.S. Pat. No. 4,597,781 issued to Spector on July 1, 1986. Another is the "Air Purifier and Ionizer" specified in U.S. Pat. No. 4,253,852 issued to Adams on Mar. 3, 1981. Yet another example of the art is the "Dust Collecting Down Draft Bench" of U.S. Pat. No. 3,295,298 issued to Mackey on Jan. 3, 1967. There is also an "Electronic Air Cleaner" by Kanazawa which includes a mechanical pre-filter as described in U.S. Pat. No. 3,988,131 issued on Oct. 26, 1976. There are also air cleaners and dust collectors such as in Yanagaway, U.S. Pat. No. 4,662,903 issued May 5, 1987; Verity, U.S. Pat. No. 4,376,642 issued Mar. 15, 1983; Axelrod, U.S. Pat. No. 4,048,693 issued Sept. 20, 1977; and the air cleaning apparatus of Frei, et al., U.S. Pat. No. 4,627,862 issued Dec. 9, 1986.

None of this art addresses the task of providing a dust free environment in the immediate vicinity of one's face during the insertion of a contact lens nor the problems caused by dust particles adhering to a contact lens prior to insertion nor the necessity for an apparatus specifically adapted to prevent, mitigate, or eliminate problems caused by the attachment of these airborne dust particles to the contact lens and remaining there at insertion into the eye and attachment to the cornea. When a contact lens is attached to the cornea and a foreign body is caught inbetween the cornea and the lens, the cornea is often irritated by the body foreign body being there.

In the home or office it is not only essential to remove dust and large size contaminants from the air in the vicinity of the face and contact lens to be able to insert a contact lens which is free of particles inbetween the contact lens and the eye which may irritate the eye, it is also desirable to provide an air flow mechanism capable of washing course contaminants and loose hair from the fingers, face, eyelids, eyelashes, eyebrows, facial hair and hair located on the crown of the head prior to insertion to insure that the contact lens is cleaned of any irritating particles.

In view of the foregoing, the main object of the invention is to provide a unit suitable for the home or office which not only washes the face and hands with a filtered stream of air but also functions to impart a filtered supply of air to the face which substantially eliminates airborne particles from falling onto a contact lens and remaining there during insertion.

More particularly, the object of this invention is to provide a unit of the above type which reduces the probability of particles and dust being deposited on the surface of a contact lens prior to its insertion and attachment to the surface of an eyeball and yet not blow away the lens due to its over capacity.

SUMMARY OF THE INVENTION

Briefly stated, the present invention is a unit adapted to remove particles of a dust and lint character from the ambient atmosphere in the vicinity of a person's face. The unit is provided with a housing having an air inlet and a plurality of uniquely arranged air outlets. A mechanical air filter is placed in the housing at the air inlet directly in front of an electric fan of a particularly determined capacity. Filtered air is drawn by means of the fan at the air inlet and forced through the filter to the air outlets. The filtered air is then distributed about the face through an inverted U-shaped air conduit seated inside the housing. For removal of contaminants from the hair and hands, a high velocity outlet is provided near the top of the housing whereby the contact lens user can wash the forehead and face area and hands prior to beginning a contact lens insertion.

DESCRIPTION OF THE DRAWINGS

For a better understanding of the invention as well as other objects and further features thereof, reference is made to the following detailed description of the preferred embodiment to be read in conjunction with the accompanying drawings, wherein:

FIG. 3 is a top view of the unit shown in FIG. 1;

FIG. 4 is a bottom view of the unit of FIG. 1;

DESCRIPTION OF THE INVENTION

Figure 1:
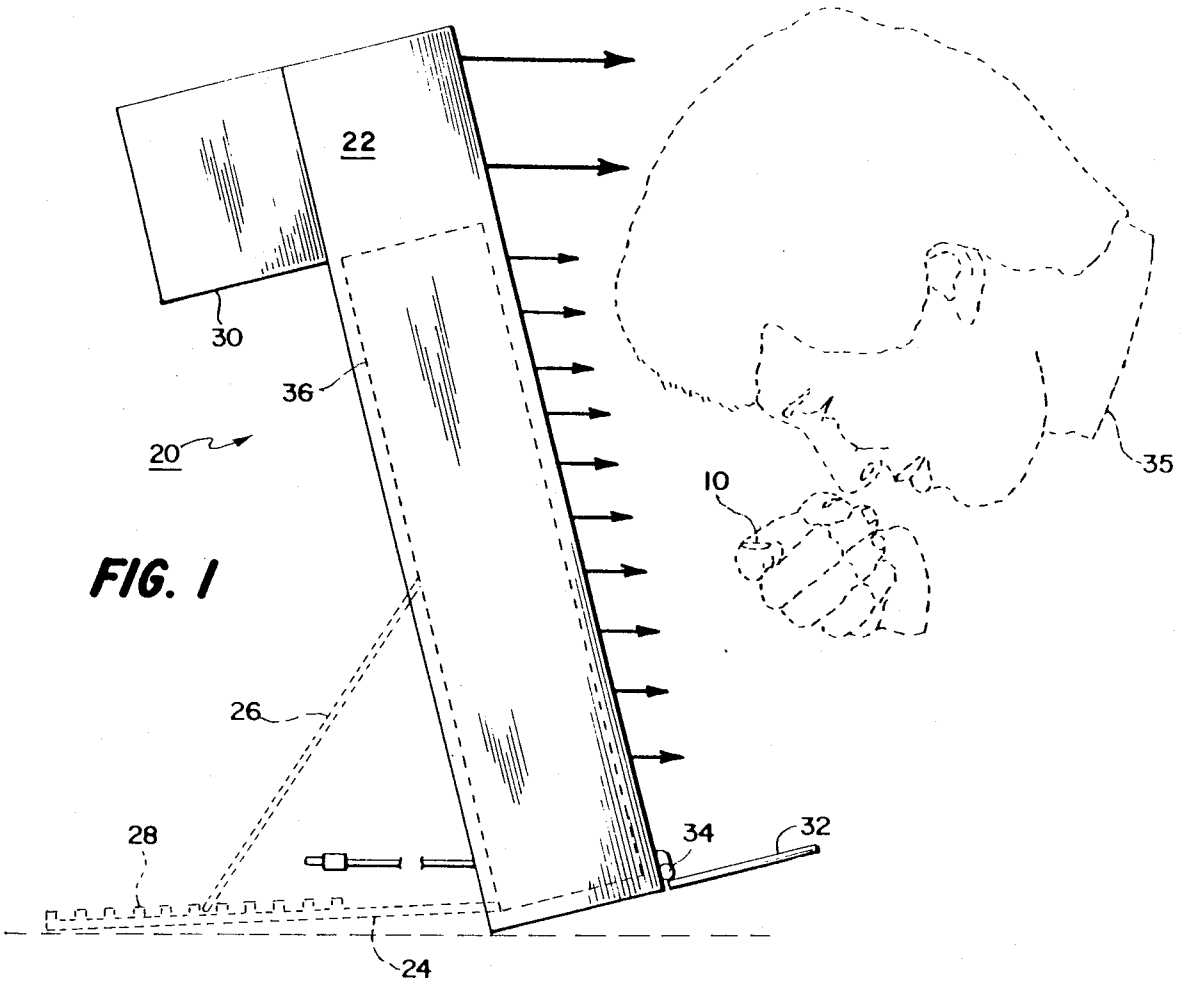
FIG. 1 is a side view of a contact lens and facial air cleaner unit in accordance with the invention.

Referring to FIG. 1, there is shown an air filter unit 20 in accordance with the invention to assist the insertion of a contact lens 10. The unit 20 includes a housing comprising a casing 22 having a rectangular boxlike shape. The unit 20 is mounted on a base 24 which supports the unit 20 by means of a lever 26 which engages a ratchet plate 28. An inlet tube 30, attached to the casing 22, extends transversely therefrom and forms a part of the casing 22. The structure made of the tube 30 and casing 22 may be molded in one piece of synthetic plastic material such as PVC, for example.

A mirror 32 is show attached to the front of the casing 22 by means of a hinge 34, for example. The hinge 34 permits the mirror 32 to be flipped up (see FIG. 3 and FIG. 4). The function of the mirror 32 assists a contact lens wearer 35 during insertion of the contact lens 10.

A first low velocity air outlet 36 is shown in dashed outline in FIG. 1.

Figure 2:
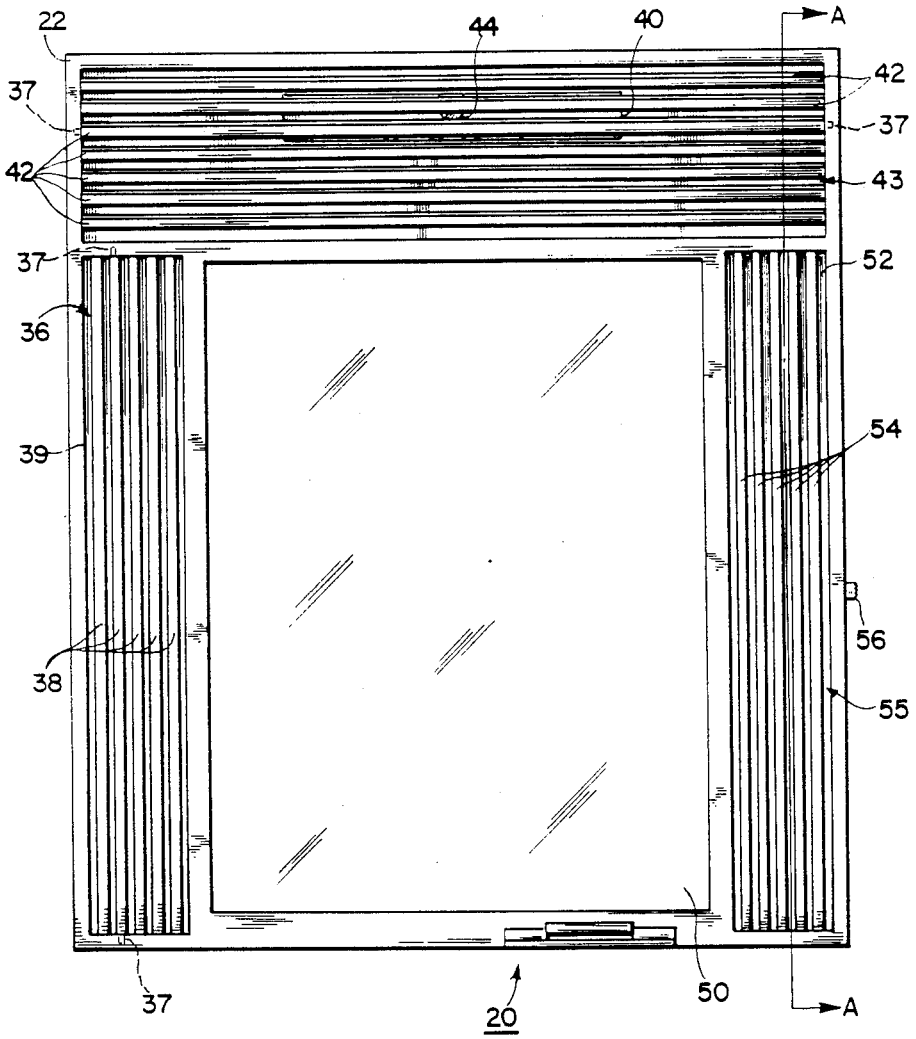
FIG. 2 is a front view of the unit of FIG. 1.

As shown in FIG. 2, the low velocity air outlet 36 is covered by a plurality of louvers 38 each end of which is pivotally mounted on a pin 37, for example, or other suitable means to allow the louvers 38 to pivot and thereby define the direction of air flow out of the low velocity air outlet 36. The louvers 38 are located within a cavity 39 of the casing 22.

FIG. 2 shows a high velocity air outlet 40 behind a series of horizontally oriented louvers 42. The louvers 42 are also piviotally attached by pins 37 to a second longitudinal cavity 43 inside the casing 22. Each of the louvers 42 are mounted on a pair of pins 37, one at each end for example, or by other suitable means to allow the louvers 42 to pivot and thereby define the direction of air flow, for example 30 cfm, out of the high velocity air outlet 40. The high velocity air outlet 40 is spatially arranged in the unit 20 to be the closest outlet to a blower fan 44.

The low velocity air outlet 36 is a large aperture and is located a greater distance away from the blower fan 44 thus resulting in a lower velocity air flow, for example 15 cfm. The low velocity air outlet 36 is covered by the plurality of louvers 38 similarly attached to a longitudinal cavity 39 by pairs of pins 37, one at each end of each louver 38, for example, or by other suitable means for allowing the louvers 38 to pivot and direct air flow up to 15 cfm, for example.

Centrally located within the front of the unit 20, is a second viewing mirror 50. On the right of the unit 20 there is a second similar low velocity air outlet 52 covered by a similar plurality of vertically oriented louvers 54. Each of the louvers 54 are mounted on a pair of pins 37, for example, or other suitable means to allow the louvers 54 to pivot in a cavity 55 within the casing 22. Located on the right side of the casing 22 is a sliding on/off electrical switch 56, for example, electrically connected to the electric fan 44 housed and mounted behind the high velocity air outlet 40. The air outlets 36, 52, and 40 are arranged in an inverted U-shape around the mirror 50. The function of the mirror 50 is to assist a user during insertion of a lens.

FIG. 3 shows the casing 22 of the unit 20 with the auxillary hinged mirror 32 connected to the casing 22.

FIG. 4 shows a bottom view of the unit 20 and the transversely extending inlet tube 30.

Figure 5:
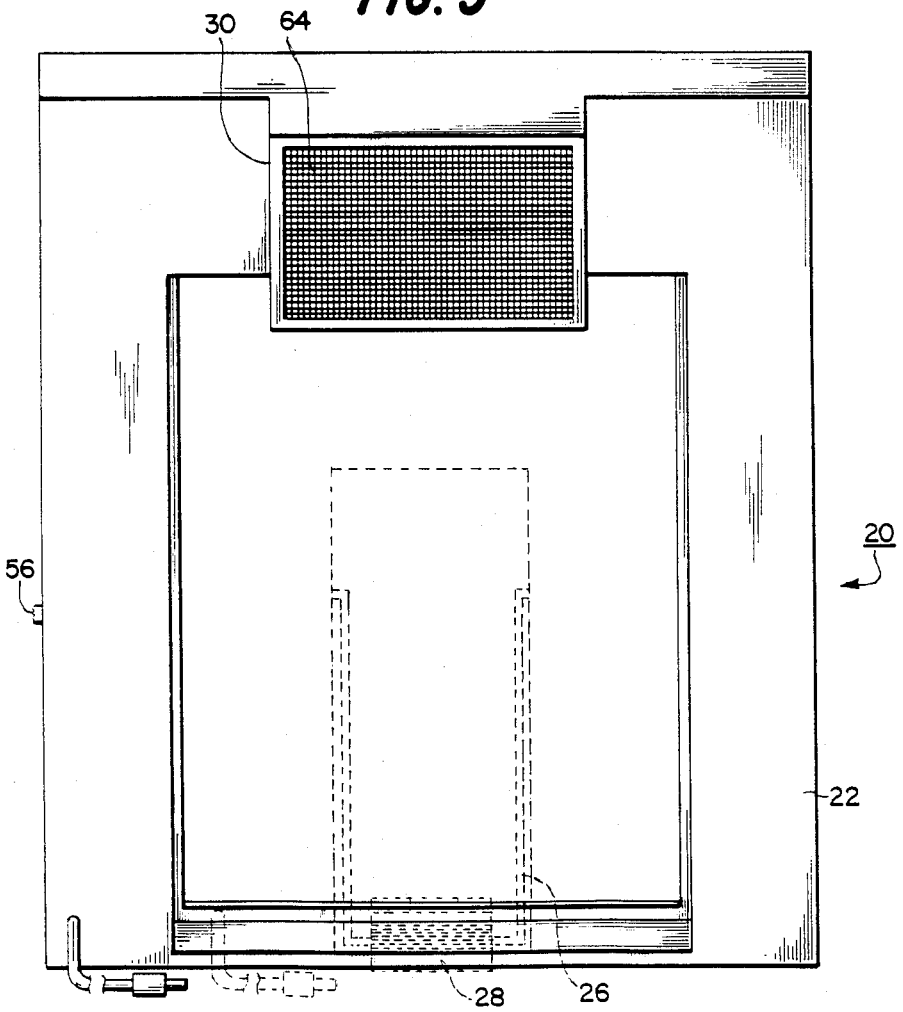
FIG. 5 is a rear view of the unit shown in FIG. 1.

FIG. 5 shows the rear of the unit 20. There is shown the mechanical filter 64 made of open cell plastic foam, for example. The inlet tube 30 houses the filter 64. Behind the filter 64 is the fan 44 (not shown). On the left is the switch 56 for the fan 44. The unit 20 is supported by the lever 26 cooperating with the ratchet plate 28.

Figure 6:
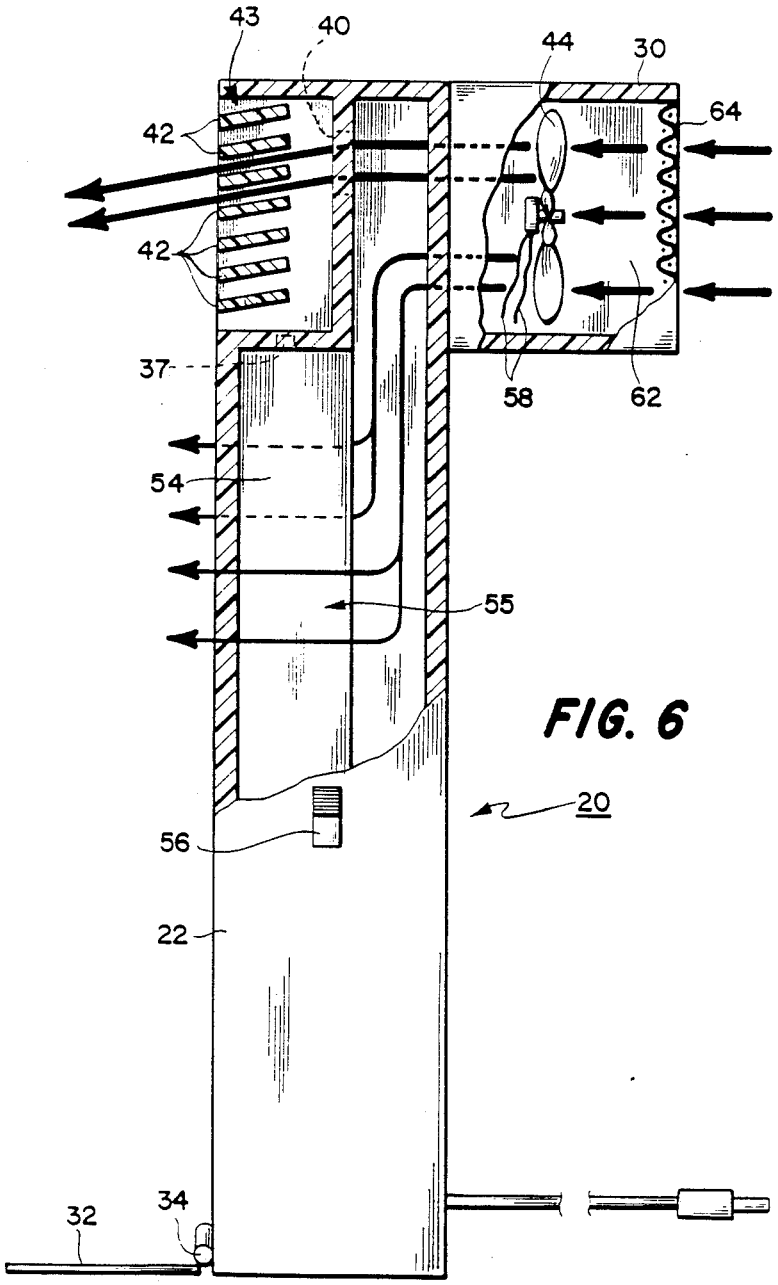
FIG. 6 is a side view of the unit as shown in FIG. 2 along the sectional line A—A.

In FIG. 6, there is shown a partial cut-away view of the unit 20 of FIG. 2, the cut-away being taken along the line A—A. Shown are the horizontal louvers 42 which direct the flow of air out of the high velocity air outlet 40. The electric fan 44 is electrically connected by means of the wires 58 to the electrical switch 56. The low velocity air outlet 52 is beneath the high velocity air outlet 40. One of the vertically oriented louvers 54 is exposed. A side aspect of a vertical louver 54 is partially illustrated. The flow of air from the fan 44 down to the outlet 52 and out through the front of the unit 20 is shown by vectors. The horizontally oriented louvers 42 are contained within the cavity 43 located in the uppermost part of the casing 22. The inlet 30 contains a space 62 which houses the fan 44 and the air filter 64. The fan 44 draws air from the outside ambient at the rear of the unit 20 through the air filter 64 and disperses this air at a high velocity through the outlet 40 and at a lower velocity through the outlet 52. The casing 22 defines a cavity 55 in front of the low velocity outlet 52. The cavity 55 contains the vertical louvers 54. Also illustrated is the pin 37. (A pin 37 is located at the top and bottom of each of the louvers 54 and each of the louvers 38 [not shown].)

Figure 7:
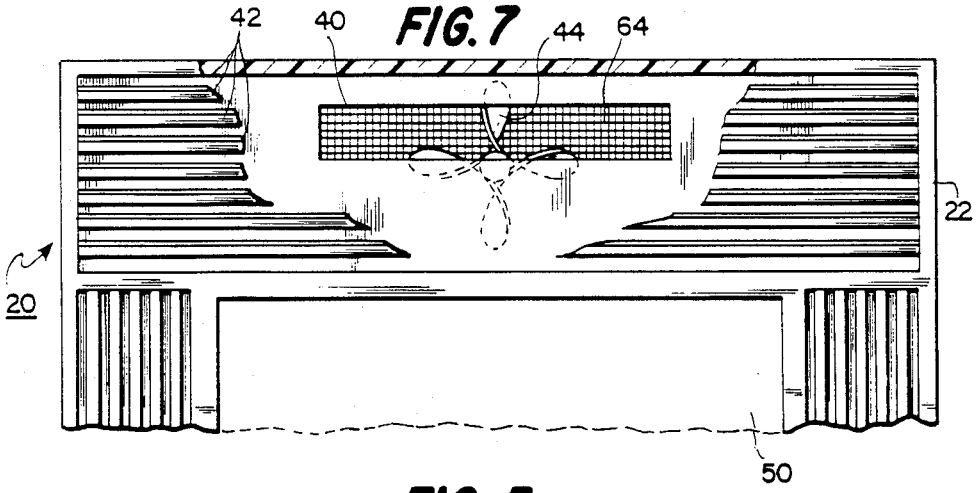
FIG. 7 is a partial sectional view of the top of the unit shown in FIG. 2 with a cut-a-way showing a high velocity air outlet and fan; and, FIG. 8 is a schematic diagram of the unit to illustrate the function of its components.

Shown in FIG. 7 is the unit 20 and the fan 44 with the horizontally oriented louvers 42 partially cut away to illustrate the high velocity air outlet 40.

Figure 8:
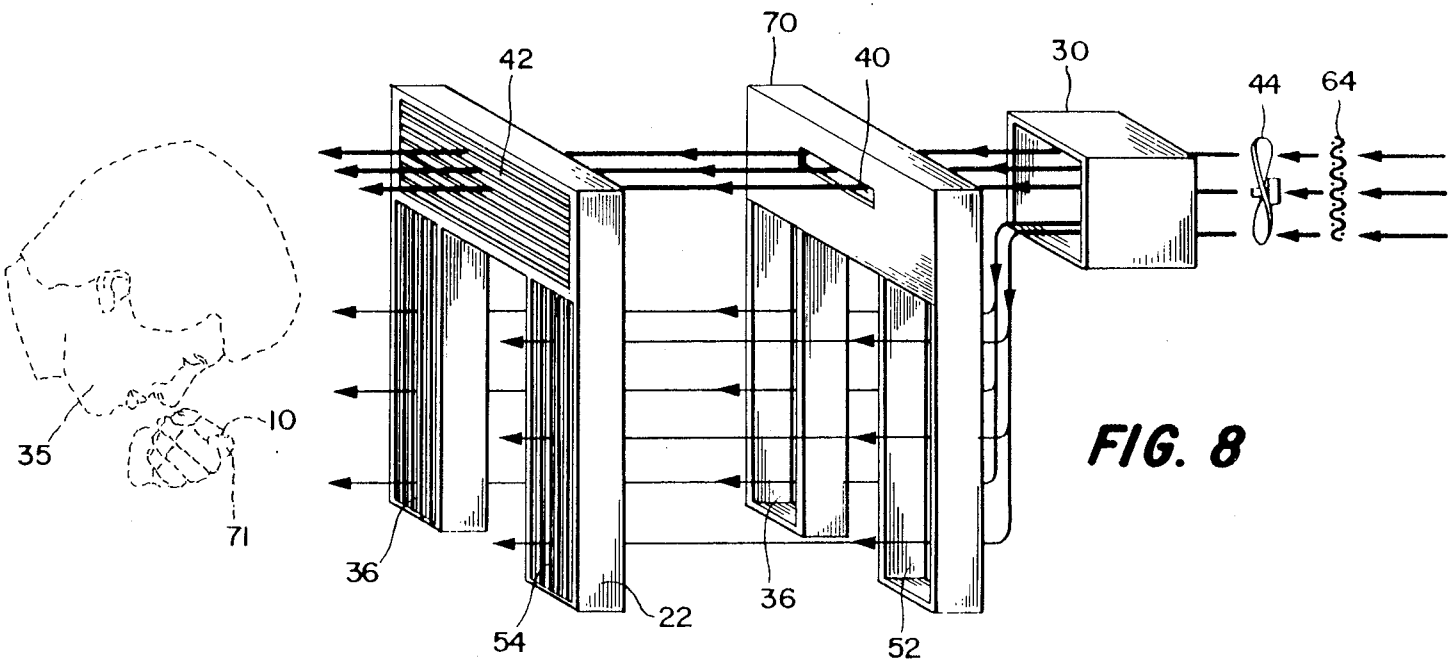

Operational aspects of the novel invention are illustrated in FIG. 8. There, shown in block form, is the fan 44 drawing air through a mechanical filter 64. The filtered air, illustrated by vectors, is channelled through the air inlet tube 30 whereby it is distributed by a novel inverted U-shaped internal component 70 made up of the high velocity air outlet 40 connected to the low velocity air outlets 36 and 52. The component 70 acts as a conduit for air flow to form an inverted U-shaped curtain of air around the user's face 35. Filtered air from these outlets 40, 36, and 52 is directed outward and passes through the louvered casing 22. The filtered air is directed at the face 35 and contact lens 10 (of a contact lens user) during the process of inserting the contact lens 10. The unit 20 provides a curtain of clean air with foreign particles and particles of dust and lint substantially reduced or eliminated during insertion of the contact lens 10.

Finally, although the operational aspects are shown in FIG. 8 in block diagram form for the purpose of conveying operative aspects of the unit, the casing 22, the inverted U-shaped component 70 and the inlet tube 30 may be made by injection molding as an integral unit with the louvers 36, 42, and 54 of the housing 22 being molded in a fixed position. The fixed position of the horizontal louvers 42 would be slightly downward at approximately a 20 degree angle and the fixed position of the vertical louvers 36 and 54 would be slightly inward toward the mirror 50 at approximately a 20 degree angle. Further, in the preferred embodiment, the fan 44 has a three inch diameter blade and operates on 120 volts at 60 cycles. The fan 44 is capable of moving 32 cubic feet of air per minute (cfm) through the input tube 30 and may provide multiple lower speeds.

The novel component 70 by providing high velocity air at the forehead level of the face 35 and yet low velocity air up to that level in an inverted U-shape enables a user to safely raise the contact 10 on the fingertip 71 without same being blown off the fingertip 71 by air flow created by the fan 44.

What is claimed is:

1. A contact lens and facial ambient air cleaner for a human face comprising:

A housing having an air inlet and an inverted U-shaped air outlet;

a mechanical air filter placed in said housing at the air inlet;

an electric fan seated in said housing and adapted to cause a flow of air from said air inlet to said inverted U-shaped air outlet;

an inverted U-shaped component inside said housing in between said mechanical air filter and said inverted U-shaped air outlet, said inverted U-shaped air outlet being adapted to partially surround a human face with an inverted U-shaped curtain of filtered air;

said outlet enclosing said component, said component comprising first and second spaced-apart parallel longitudinal apertures each having an uppermost and a lowermost extremity, each longitudinal aperture being adapted to provide low velocity air flow on each side of the human face;

said component further comprising a third aperture located in between the uppermost extremities of said first and second apertures;

said component further comprising means for providing high velocity air flow from said third aperture;

said inverted U-shaped air outlet being adapted to direct said high velocity air flow towards an upper part of the human face.

2. A contact lens and facial ambient air cleaner comprising:

A housing having an air inlet and an inverted U-shaped outlet;

a mechanical filter placed in said housing at the air inlet;

an electric fan seated in said housing and adapted to cause a flow of air from said air inlet to said outlet; and said inverted U-shaped outlet being adapted to partially surround a human face with an inverted U-shaped curtain of filtered air.

3. A contact lens and facial ambient air cleaner comprising:

A housing having an air inlet;

a mechanical filter placing in said housing at the air inlet;

a first means in said housing adapted to cause a flow of air from said air inlet to;

a second means located inside said housing for surrounding a human face with an inverted U-shaped curtain of filtered air;

said second means comprising an inverted U-shaped component and first and second interconnected apertures adapted to provide an outlet for low velocity air flow on each side of a human face;

a third aperture located in said housing for providing high velocity air flow; said third aperture located near the uppermost extremities of said first and second apertures, said third aperture being substantially smaller than said first and second apertures.

4. A contact lens and facial air cleaner comprising two longitudinal outlets for air flow of low velocity innerconnected to a third outlet adapted for air flow of substantially higher velocity, said third outlet being located at the uppermost aspect of said two longitudinal outlets and means for providing a lateral flow of filtered air in an inverted U-shape partially surrounding a contact lens user's facial area during contact lens insertion.

* * * * *